US006524776B2

(12) United States Patent
Goan

(10) Patent No.: US 6,524,776 B2
(45) Date of Patent: Feb. 25, 2003

(54) PHOTOTHERMOGRAPHIC IMAGE FORMING MATERIAL

(75) Inventor: Kazuyoshi Goan, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/023,781

(22) Filed: Dec. 18, 2001

(65) Prior Publication Data

US 2002/0136991 A1 Sep. 26, 2002

(30) Foreign Application Priority Data

Dec. 22, 2000 (JP) ..... 2000-390616

(51) Int. Cl.[7] ..... G03C 5/16
(52) U.S. Cl. ..... 430/350
(58) Field of Search ..... 430/350, 619, 430/620

(56) References Cited

U.S. PATENT DOCUMENTS 6,132,949 A * 10/2000 Fujita et al. ..... 430/619
6,143,489 A * 11/2000 Yamashita ..... 430/619
6,297,001 B1 * 10/2001 Takiguchi et al. ..... 430/619

* cited by examiner

*Primary Examiner*—Thorl Chea
(74) *Attorney, Agent, or Firm*—Bierman, Muserlian and Lucas

(57) ABSTRACT

A photothermographic material comprising a support having thereon a photosensitive layer comprising non-photosensitive organic silver salt grains, photosensitive silver halide grains, a binder, a cross-linking agent, and a reducing agent, wherein a silver coverage in the photosensitive layer is from 0.3 to 2.0 g/m$^2$; the number of developed silver halide grains $N_1$ in the maximum density area is from $5\times10^{13}$ to $1\times10^{15}$/m$^2$ when the photothermographic material is subjected to exposure in an exposure amount of 280 $\mu$J/cm$^2$ and subsequently is subjected to heat development at 123° C. for 16.5 seconds; and, in the maximum density area, the number of developed silver halide grains $N_1$ and the number of undeveloped silver halide grains $N_2$ satisfy the formula; $0.70 \leqq N_1/(N_1+N_2) \leqq 0.95$.

6 Claims, No Drawings

PHOTOTHERMOGRAPHIC IMAGE FORMING MATERIAL

FIELD OF THE INVENTION

The present invention relates to a photothermographic material which forms an image by an irradiation of light followed by heat development.

BACKGROUND OF THE INVENTION

Heretofore, in the medical and printing plate making fields, effluent resulting from wet type processing for image forming materials became problematic in terms of workability, and in recent years, from the viewpoint of environmental protection as well as space saving, a decrease in processing effluent has been highly demanded. Accordingly, it has been requested to achieve a technology, employing photothermographic materials, for use in photographic techniques in which efficient exposure can be performed utilizing laser imagers and image setters, and can form clear black-and-white images at high resolution.

Heat developable photosensitive materials, which produce photographic images employing a heat development processing method as the technique to meet said demand, are disclosed, for example, in U.S. Pat. Nos. 3,152,904 and 3,487,075, and D. Morgan, "Dry Silver Photographic Material" or D. H. Klosterboer, "Thermally Processed Silver Systems" (Imaging Processes and Materials, Neblette, 8th Edition, edited by J. M. Sturge, V. Walworth, and A. Shepp, page 279, 1989).

Incidentally, these heat developable photosensitive materials are characterized in that photosensitive silver halide grains provided in the photosensitive layer are utilized as a light sensor, and organic silver salts are utilized as the silver ion supplying source, and images are formed by conducting heat development commonly at 80 to 140° C., employing incorporated reducing agents, without the requirement of fixing the image. Accordingly, in order to efficiently supply silver ions to silver halide, as well as to simultaneously minimize a decrease in transparency due to light scattering, much effort has been made for improvement in the organic silver grain shape so that grains are easily positioned at proper locations and do not adversely affect said light scattering.

For achieving said objectives, it has been attempted to prepare fine grains simply through high-energy dispersion employing a homogenizer or crushing them. However, in such attempts, problems occurred in which fog increased and sensitivity decreased due to the damage of silver halide grains and organic silver salt grains, and in addition, image quality was also degraded. Therefore, techniques have been demanded which make it possible to obtain high sensitivity as well as high image density without increasing the silver amount and also to reduce fogging.

On the other hand, since said heat developable photosensitive material is comprised of organic silver salts, photosensitive silver halide grains, and reducing agents, it results in problems in which it tends to result in fogging during storage prior to heat development as well as during heat development, and during storage after the heat development, it tends to also result in fogging as well as formation of photolytic silver (printout silver). Particularly, said photosensitive material needs to be subjected to only heat development at 80 to 250° C. without fixing. As a result, problems have occurred in which the color of silver images varies due to heat and light when silver images are stored for a long period of time in the presence of the silver halide, organic silver salts and reducing agents remaining in unexposed areas.

Some of the causes of said problems are assumed to be as follows. Namely, since there are reducing agents in said photosensitive material, heat fogging tends to result due to the reaction of said reducing agent with organic silver salts. Further, since said reducing agents function as a hole trap, except the original function of said reducing agents which reduce silver ions even when exposed to light with different wavelengths from those for image recording, in the system comprised of silver halide grains and organic silver salts, printout silver inevitably increases.

Further, other than said causes, it is also assumed that fogging specks, which result in fogging, are formed in the production process of said photosensitive materials.

Techniques to overcome these problems are disclosed in Japanese Patent Publication Open to Public Inspection Nos. 6-208192 and 8-267934, and U.S. Pat. No. 5,714,311, and in the references cited in these patent specifications. However, these disclosed techniques exhibit some desirable effects, but are not sufficient to satisfy market demands.

DETAILED DESCRIPTION OF THE INVENTION

An object of the present invention is to provide a heat developable photosensitive material which exhibits high covering power, high sensitivity, and low fogging; results in minimized fogging when stored for a long period of time; and exhibits improved silver image retention properties as well as improved sliver image color, and an image recording method as well as an image forming method using the same.

Said object of the present invention was achieved employing items 1 through 6, described below.

1. A photothermographic material comprising a support having thereon a photosensitive layer comprising non-photosensitive organic silver salt grains, photosensitive silver halide grains, a binder, a cross-linking agent, and a reducing agent, wherein a silver coverage in said photosensitive layer is from 0.3 to 2.0 g/m$^2$; the number of developed silver halide grains $N_1$ in the maximum density area is from $5\times10^{13}$ to $1\times10^{15}$/m$^2$ when said photothermographic material is subjected to exposure in an exposure amount of 280 $\mu$J/cm$^2$ and subsequently is subjected to heat development at 123° C. for 16.5 seconds; and, in the maximum density area, the number of developed silver halide grains $N_1$ and the number of undeveloped silver halide grains $N_2$ satisfy the formula;

$$0.70 \leqq N_1/(N_1+N_2) \leqq 0.95.$$

"A silver coverage" means "an amount of silver calculated from the coating amount of non-photosensitive organic silver salt grains and photosensitive silver halide grains in the photosensitive layer.

"The maximum density" in the present invention is usually from 3.0 to 4.5.

2. The photothermographic material of item 1, wherein 1.5 to 90 weight % of said photosensitive silver halide grains is prepared by allowing non-photosensitive organic silver salt grains to react with a compound which contains a reactive halogen atom in the molecule.
3. The photothermographic material of item 1, wherein 5 to 80 weight % of said photosensitive silver halide grains is prepared by allowing non-photosensitive organic silver salt grains to react with a compound which contains a reactive halogen atom in the molecule.

4. The photothermographic material of item 1, wherein 10 to 70 weight % of said photosensitive silver halide grains is prepared by allowing non-photosensitive organic silver salt grains to react with a compound which contains a reactive halogen atom in the molecule.
5. The photothermographic material of item 2, wherein the compound which contains a reactive halogen atom in the molecule is an onium salt having a halide anion or a polyhalide anion in the molecule.
6. A method of forming an image of photothermographic material, comprising the steps of:
   (a) exposing said a photothermographic material with an exposure amount of 280 $\mu J/cm^2$; and
   (b) thermally developing said a photothermographic material at 123° C. for 16.5 seconds, wherein said photothermographic material comprises a support having thereon a photosensitive layer comprising non-photosensitive organic silver salt grains, photosensitive silver halide grains, a binder, a cross-linking agent, and a reducing agent; a silver coverage in said photosensitive layer is from 0.3 to 2.0 $g/m^2$; the number of developed silver halide grains $N_1$ in the maximum density area is from $5\times10^{13}$ to $1\times10^{15}$ per $m^2$; and in the maximum density area, the number of developed silver halide grains $N_1$ and the number of undeveloped silver halide grains $N_2$ satisfy the formula;

$$0.70 \leqq N_1/(N_1+N_2) \leqq 0.95.$$

Said object of the present invention can further be achieved by employing items 7 through 9, described below.

7. An image recording method wherein said heat developable photosensitive material, described in any one of item 1 through item 5 above, is subjected to exposure employing a laser scanning exposure device so that the angle between the exposed surface of said heat developable photosensitive material and the scanning laser beam does not become perpendicular.
8. An image recording method wherein when an image is recorded onto said heat developable photosensitive material, described in any one of item 1 through item 3, exposure is carried out utilizing vertical multiple scanning beams, generated from a laser scanning exposure device.
9. An image forming method wherein said heat developable photosensitive material, described in any one of item 1 through item 5, is developed while heated at 80 to 200° C.

The present invention will now be detailed below

The heat developable photosensitive photographic material of the present invention is characterized in that said material has a coated silver amount of 0.3 to 2.0 $g/m^2$; when subjected to exposure in an exposure amount of 280 $\mu J/cm^2$ and subsequently subjected to development at 123° C. for 16.5 seconds, the number of developed silver halide grains in the maximum density area is from $5\times10^{13}$ to $1\times10^{15}$; and (the number of developed silver halide grains)/(the number of developed silver grains+the number of undeveloped silver halide grains) is from 70 to 95 percent. Further, the heat developable photosensitive photographic material of the present invention, which exhibits the characteristics above, exhibits high sensitivity as well as low fog; results in minimized fogging when stored over a long period of time; and results in improvement in silver image retention properties as well as silver image color after development.

The development at 123° C. for 16.5 seconds, as described in the present invention, means that heat development is carried out in such a manner that said heat developable photosensitive photographic material comes into contact with a heat development drum at a surface temperature of 123° C. for 16.5° C.

The method for determining the aforementioned number of developed silver halide grains as well as the number of undeveloped silver grains will now be described.

In the present invention, the number of developed silver halide grains in the maximum density area and (the number of developed silver halide grains)/(the number of developed silver grains plus the number of undeveloped silver halide grains) are determined as described below.

Said heat developable photosensitive material is subjected to exposure in an exposure amount of 280 $\mu J/cm^2$ and subsequently to development at 123° C. for 16.5 seconds. The photosensitive layer, coated on the support of the resulting material, is adhered onto a suitable holder, employing an adhesive, and a 0.1 to 0.2 $\mu m$ thick ultra-thin slice is prepared utilizing a diamond knife in the perpendicular direction against said support.

Subsequently, said ultra-thin slice is held employing a copper mesh, and is transferred onto a hydrophilic carbon film utilizing glow discharge. Thereafter, while cooled at −130° C. or lower, employing liquid nitrogen, bright field images are observed at a magnification factor of 5,000 to 40,000, employing a transmission type electron microscope (hereinafter referred to as TEM), and the images are quickly recorded employing a film, an image plate, or a CCD camera. During said operation, it is preferable that the field of vision is suitably determined so as to select a part of said slice having neither tears nor looseness.

Said carbon film, which is supported along with a very thin organic film such as collodion or Formvar, is preferably employed. More preferably, however, said carbon film is obtained in such a manner that the film is formed on a rock salt substrate which is removed through dissolution, or a film comprised of only carbon is obtained by removing said organic film utilizing organic solvents or etching. The acceleration voltage of TEM is preferably from 80 to 400 kV, and is most preferably from 80 to 200 kV.

Recorded images may be subjected to image treatment and developed silver grains as well as undeveloped silver grains are observed. Based on said observation, the number of developed silver halide grains as well as the number of undeveloped silver grains is calculated per $m^2$.

The coated silver amount according to the present invention is determined employing analytical methods conventionally known in the art. For example, said heat developable photosensitive material is cut to a suitable size. Subsequently, the X-ray intensity of a target element in the cut sample is determined employing a fluorescent X-ray spectrometer Model 3080 (manufactured by Rigaku Denki Kogyo Co., Ltd.), whereby it is possible to calculate said coated silver amount based on the resulting intensity.

Organic silver salts according to the present invention will now be described.

In the present invention, said organic silver salts are reducible silver sources which include silver salts of organic acids and heterorganic acids. Of these, silver salts comprising long chains (having from 10 to 30 carbon atoms and preferably from 15 to 25 carbon atoms), aliphatic carboxylic acids, and nitrogen containing heterocyclic compounds are preferred. In addition, organic or inorganic complexes, described in Research Disclosure Items 17029 and 29963 are preferred in which the ligand has a total stability constant of 4.0 to 10.0 with respect to silver ions. Listed as examples of suitable silver salts are those described below.

Silver salts of organic acids (for example, silver salts of gallic acid, oxalic acid, behenic acid, arachidinic acid, stearic acid, palmitic acid, and lauric acid); silver salts of carboxyalkylthiourea (for example, 1-(3-carboxypropyl) thiourea and 1-(3-carboxypropyl)-3,3-dimethylthiourea); silver salts and complexes of polymer reaction products of aldehyde and hydroxy-substituted aromatic carboxylic acid (for example, silver salts and complexes of reaction products of aldehydes such as formaldehyde, acetaldehyde, and butyl aldehyde and hydroxy-substituted aromatic carboxylic acids such as salicylic acid, benzoic acid, 3,5-dihydroxybenzoic acid, and 5,5-thiodisalicylic acid; silver salts and complexes of thiones (for example, 3-(2-caroxyethyl)-4-hydroxymethyl-4-thiaziline-2-thione and 3-carboxy-4-thiazoline-2-thione); complexes or salts of silver with nitrogen acids selected from imidazole, pyrazole, urazole, 1,2,4-thiazole, and 1H-tetrazole, 3-amino-5-benzylthio-1,2,4-triazole, and benzotriazole; silver salts of saccharin and 5-chlorosalitylaldoxime; and silver salts of mercaptan derivatives. Of the organic silver salts described above, silver behenate, silver arachidiate and/or silver stearate are preferably employed.

Organic silver salts are prepared by mixing water-soluble silver compounds with compounds forming complexes with silver. Preferably employed as mixing methods are a normal mixing method, a reverse mixing method, and a double-jet method. Further, the controlled double-jet method as described in Japanese Patent Publication Open to Public Inspection No. 9-127643 is also preferably employed. For example, after preparing an organic acid metal salt soap (for example, sodium behenate and sodium arachidiate) by adding alkali metal salts (for example, sodium hydroxide and potassium hydroxide) to organic acids, organic silver salt crystals are prepared by mixing said soap and silver nitrate, employing a controlled double-jet method. During said preparation, silver halide grains may be mixed.

It is possible to employ various shapes of organic silver salts according to the present invention, but grains having a tabular shape are preferred. In addition, grains are preferred which are particularly tabular organic silver salt grains having an aspect ratio of at least 3, and an average value of acicular ratio of said tabular organic silver salt grains of 1.1 to 10 which measured from the major plane direction so as to carry out filling grains in the photosensitive layer by decreasing the shape anisotropy of two facing planes (major planes) in almost parallel having the maximum area. Further, said acicular ratio is more preferably from 1.1 to 5.0.

Incidentally, having tabular organic silver salt grains having an aspect ratio of at least 3, as described in the present invention, means that said tabular organic silver salt grains share at least 50 percent of the total number of organic silver salts grains'. Further, in organic silver salts according to the present invention, tabular organic silver salts grains preferably share at least 60 percent by number of the total of organic silver salt grains, more preferably share at least 70 percent (by number),and most preferably share at least 80 percent (by number).

The tabular grains having an aspect ratio of at least 3, as described in the present invention, refer to those having the ratio of the average grain diameter to the average thickness, a so-called aspect ratio (hereinafter referred to as AR) represented by the formula described below of at least 3.

$$AR = \text{average grain diameter (in } \mu\text{m)/average thickness (in } \mu\text{m)}$$

The AR of the tabular organic silver salt grains according to the present invention is preferably from 3 to 20, and is more preferably from 3 to 10. The reason for this is as follows. When the AR is excessively small, said organic silver salt grains tends to result in closest packing. On the other hand, when the AR is excessively large, organic silver salt grains tend to overlap each other, and tend to be dispersed in the adhered state, due to which light scattering tends to occur and the transparency of said photosensitive material is degraded. As a result, it has been determined that said range is preferable.

Said average grain diameter was obtained as follows. Dispersed organic silver salts were diluted, dispersed onto a grid fitted with a carbon supporting film, and imaged at a direct magnification of 5,000, employing a TEM (2000FX Type, manufactured by Nippon Denshi). The grain diameter (being the circle equivalent diameter) of at least 300 grains was determined utilizing suitable image processing software upon reading negative images as digital images employing a scanner. Subsequently, an average grain diameter was calculated.

Said average thickness was calculated according to the method utilizing a TEM described below.

Initially, the photosensitive layer, coated onto the support, is adhered onto a suitable holder employing an adhesive. Subsequently, employing a diamond knife, 0.1 to 0.2 $\mu$m ultra-thin slices are cut in the perpendicular direction against said support. Subsequently, the prepared ultra-thin slice is held employing a copper mesh, and is transferred onto a hydrophilic carbon film utilizing glow discharge. Thereafter, while cooled at −130° C. or lower employing liquid nitrogen, the bright field image is observed by a factor of 5,000 to 40,000, employing a TEM, and the image are quickly recorded employing film, an image plate, or a CCD camera. During said operation, it is preferable that the field of vision is suitably determined so as to select a part of said slice having neither tears nor looseness.

Said carbon film, which is supported with a very thin organic film such as collodion or Formvar, is preferably employed. Further, more preferably, said carbon film is obtained in such a manner that the film is formed on a rock salt substrate which is removed through dissolution, or a film comprised of only carbon is obtained by removing said organic film utilizing organic solvents, or by etching. The acceleration voltage of the TEM is preferably from 80 to 400 kV, but is most preferably from 80 to 200 kV.

It is preferable that the TEM image recorded on a suitable medium is subjected to image processing, utilizing a computer upon decomposing one sheet of said image into at least 1,024×1,024 pixels, or preferably at least 2,048×2,048 pixels. In order to conduct desired image processing, it is preferable that an analogue image recorded on a film is converted to a digital image, employing a scanner and if desired, is subjected to shading correction and contrast-edge enhancement. Thereafter, a histogram is prepared and positions corresponding to organic silver are extracted employing binary processing.

The thickness of at least 300 organic silver salt grains, extracted as above, is determined employing suitable software, whereby the average thickness value is obtained.

The average value of the acicular ratio of tabular organic silver salt grains is obtained employing the method described below.

Initially, a photosensitive layer comprising tabular organic silver salt grains is swollen, employing organic solvents capable of dissolving the binders of said photosensitive layer, and is then peeled from the support. Subsequently, ultrasonic washing employing said solvents, centrifugal separation, and removal of the supernatant are repeated 5 times. Incidentally, said process should be carried out under a safelight.

Subsequently, the resulting product is diluted employing MEK (methyl ethyl ketone) so that the concentration of organic silver solids becomes 0.01 percent, and is subjected to ultrasonic dispersion. Thereafter, the resulting dispersion is placed dropwise onto a hydrophilic polyethylene terephthalate film, and subsequently dried.

It is preferable that a grain placed film is used for observation after obliquely vacuum-evaporating a 3 nm thick Pt-C, at an angle of 30 degrees with respect to the film surface employing an electron beam.

Regarding details of electron microscopy and sample preparation techniques, it is suggested to refer to both "Igaku.Seibutsugaku Denshikenbikyo Kansatsu Ho (Medical-Biological Electron Microscopy)" edited by Nihon Densikenbikyo Gakkai Kanto Shibu (published by Maruzen) and "Denshikenbikyo Seibutsu Shiryo Sakusei Ho (Preparation Methods of Biologial Samples for Electron Microscopy)", edited by Nihon Densikenbikyo Gakkai Kanto Shibu (published by Maruzen).

The secondary electron image of the prepared sample is observed at a magnification of 5,000 to 20,000 at an acceleration voltage of 2 to 4 kV, employing a field emission type scanning electron microscope (hereinafter referred to as FE-SEM), and the resulting image is stored in a suitable recording medium.

In order to perform said processing, it is convenient to employ a device capable of AD-converting image signals from an electron microscope itself and directly recording AD-converted signals on a memory medium as digital information. On the other hand, an analogue image recorded on a Polaroid film may be converted to a digital image, employing a scanner, and if desired, said digital image may be subjected to shade correction and contrast-edge enhancement, and then employed.

It is preferable that a sheet of the image recorded in a suitable medium is decomposed into at least 1,024×1,024 pixels, and preferably at least 2,048×2,048 pixels, and is then subjected to image processing employing a computer.

The steps of said image processing are as follows. Initially, a histogram is prepared and positions corresponding to organic silver salt grains, having an aspect ratio of at least 3, are extracted, employing binary processing. Unintentionally aggregated particles are cut utilizing a suitable algorithm or a manual operation and the profile is extracted. Thereafter, the maximum length (MX LNG) and the minimum width (WIDTH) of at least 1,000 grains are determined, and then the acicular ratio of each grain is obtained based on the formula given below. The maximum length of a grain, as described herein, refers to the maximum value when two points in the grain are connected with a straight line. On the other hand, the minimum width of a grain, as described herein, refers to the minimum value between two parallel lines which bracket said particle.

Acicular ratio=(MX LNG)÷(WIDTH)

Thereafter, the average value of the acicular ratio of all measured grains is calculated. When said measurement is carried out employing said steps, it is preferable that by employing a standard sample, length correction per pixel (being scale correcting) as well as 2-dimensional strain correction of the measurement system is sufficiently carried out. As said standard sample, Uniform Latex Particles (DULP) available from Dow Chemical (in the U.S.) is suitable. Polystyrene particles having a variation coefficient of less than 10 percent with respect to a grain diameter of 0.1 to 0.3 $\mu$m are preferred. Specifically, it is desrable to procure such a lot as with a grain diameter of 0.212 $\mu$m and a standard deviation of 0.0029 $\mu$m.

Regarding the details of image processing technology, it is suggested to refer to "Gazoshori Oyogijutsu (Image Processing Applying Technology)", edited by Hiroshi Tanaka, published by Kogyo Chosa-Kai. Image processing programs or devices are not particularly limited as long as they are able to perform said operations. Listed as one example is Luzex-III, manufactured by Nireco Co.

Each organic silver salt grain according to the heat developable photosensitive materials described in claim 1 or 3 is preferably a monodispersed grain, and the monodispersibility is preferably in the range of 1 to 30 percent. When monodispersed grains are in said range, it is possible to obtain relatively high density images. The monodispersion, as described herein, is defined based on the formula described below.

Monodispersibility=(standard deviation of grain diameter)/(average of grain diameter)×100

The average grain diameter of said organic silver salts is preferably from 0.01 to 0.8 $\mu$m, and is more preferably 0.05 to 0.5 $\mu$m. The average grain diameter (being the circle equivalent diameter) refers to the diameter of the circle having the same area as that of each observed grain image.

Methods to obtain organic silver salt grains having said shape are not particularly limited. Herein, listed as preferable conditions are those described below: a mixing state during formation of organic acid alkali metal salt soap and/or a mixing state during addition of silver nitrate into said soap should be maintained as required; the ratio of silver nitrate, which reacts with said soap, should be optimized; dispersion and crushing should be carried out employing a media homogenizer or a high pressure homogenizer; during dispersion, binders should be added in an amount of 0.1 to 10 percent with respect to the weight of organic silver; from drying to completion of main dispersion, the temperature should not exceed 45° C.; and during preparation of solutions, a dissolver should be employed while stirring at a circumferential speed of at least 2.0 m/second.

It is preferable that if desired, after tabular organic silver salt grains according to the present invention are preliminarily dispersed together with surface active agents, said grains are dispersed and crushed employing a media homogenizer or a high pressure homogenizer. In order to carry out said preliminary dispersion, it is possible to employ common stirrers such as an anchor type and a propeller type, a high speed rotation centrifugal radial type stirrer (being a dissolver), and a high speed rotation shearing type stirrer (being a homomixer).

Further, employed as said media homogenizers may be rotation mills such as a ball mill, a planet ball mill, and a vibration ball mill, medium stirring mills such as a bead mill, an attritor, and others such as a basket mill. Employed as high pressure homogenizers may be those of several types such as a wall and plug colliding type, a type in which liquid is separated into a plurality of flows which are made to collide with each other, and a type in which liquid is passed through narrow orifices.

Preferably employed as ceramics used as ceramic beads used during said dispersion are, for example, $Al_2O_3$, $BaTiO_3$, $SrTiO_3$, MgO, ZrO, BO, $Cr_2O_3$, $SiO_2$, $SiO_2$—$Al_2O_3$, $Cr_2$—MgO, MgO—CaO, Mg—C, MgO—$Al_2O_3$ (spinel), SiC, $TiO_2$, $K_2O$, $Na_2O$, BaO, PbO, $SrTiO_2$ (strontium titanate), $BeAl_2O_4$, $Y_3Al_5O_{12}$, $ZrO_2$—$Y_2O_3$ (cubic crystalline zirconia), 3BeO—$Al_2O_3$—$6SiO_2$ (synthetic emerald), C (synthetic diamond), $Si_2O$—$nH_2O$, silicon nitride, yttrium-stabilized zirconia, and zirconia-strengthened alumina. Since minimal impurities are formed due to friction of beads with a homogenizer during dispersion, yttrium-stabilized zirconia and zirconia-strengthened alumina (these containing ceramics are abbreviated as zirconia hereunder) are most preferably employed.

Preferably employed as materials of members of devices employed to disperse tabular organic silver salt grains according to the present invention are ceramics such as zirconia, alumina, silicon nitride, boron nitride or diamond. Of these, zirconia is preferably employed.

When said dispersion is carried out, it is preferable that binders are added in an amount of 1 to 10 percent by weight of the organic silver and the temperature of the liquid does not exceed 45° C. during the preliminary dispersion to the main dispersion. Further, preferred operation conditions of the main dispersion are as follows. For example, when said high pressure homogenizer is employed as the dispersion means, 29.42 to 98.06 Mpa and at least two operations are listed. Further, when said media homogenizer is employed as the dispersion means, a circumferential speed of 6 to 13 m/second is listed as the preferred conditions.

Further, it is possible to mix zirconia into a dispersed emulsion during dispersion, employing said zirconia in beads or a part of the members. Said mixing is effective to improve photographic performance. Afterwards zirconia fragments may be added to said dispersed emulsion, or may have been added during the preliminary dispersion.

Specific methods are not particularly limited. For example, when MEK is circulated in a bead mill filled with zirconia beads, it is possible to prepare a high concentration zirconia solution. The resulting solution may be added during an optimal period at an optimal concentration.

Photosensitive silver halides according to the present invention will now be described.

Said silver halides according to the present invention function as the light sensor.

In the present invention, in order to minimize milky-whiteness, as well as to produce excellent image quality, the average grain size of photosensitive silver halide grains is preferably as small as possible. Accordingly, said average grain size is preferably 0.1 μm or less, is more preferably from 0.01 to 0.1 μm, and is most preferably from 0.02 to 0.08 μm. The grain size, as described herein, refers to the diameter (being the circle equivalent diameter) of a circle having the same area as that of each grain image observed with an electron microscope. Further, said silver halide grains are preferably monodispersed. The monodispersion, as described herein, refers to the dispersion state in which the monodispersibility obtained by the formula described below is 40% or less. Said monodispersibility is more preferably 30% or less, and is most preferably 20% or less.

Monodispersibility=(standard deviation of grain diameter)/(average of grain diameter)×100

Shapes of silver halide grains are not particularly limited. However, the ratio sharing the plane having a Miller index of [100] is preferably as high as possible. Said index is preferably at least 50 percent, is more preferably at least 70 present, and is most preferably 80 percent. It is possible to obtain said ratio of a plane having a Miller index of [100] with reference to T. Tani, J. Imaging Sci., 29, 165 (1985) in which adsorption dependency of sensitizing dyes onto a [111] plane and a [100] plane is utilized.

Further, another preferred shape of silver halide grains is a tabular form. Tabular grains, as described herein, refer to those which have an aspect ratio, represented by r/h, of at least 3, wherein r (in μm) represents the grain diameter which is the square root of its projection area and h (in μm) represents the thickness in the perpendicular direction. Of said grains, the preferred aspect ratio is from 3 to 50. Further, the grain diameter is preferably 0.1 μm or less, and is more preferably from 0.01 to 0.08 μm. This is described in U.S. Pat. Nos. 5,264,337, 5,314,798, and 5,320,958, and it is possible to easily prepare the desired tabular grains.

Halide compositions are not particularly limited and include any of silver chloride, silver chlorobromide, silver chloroiodobromide, silver bromide, silver iodobromide, or silver iodide. It is possible to prepare photographic emulsions employed in the present invention, using methods described in P. Glafkides, "Chimie et Physique Photographique" (published by Paul Montel Co., 1967); G. F. Duffin, "Photographic Emulsion Chemistry" (published by The Focal Press, 1966); and V. L. Zelikman et al., "Making and Coating Photographic Emulsion" (published by The Focal Press, 1964). Namely, any of the acid method, neutral method, or ammonia method may be utilized. Further, water-soluble silver salts may be allowed to react with water-soluble halide salts employing either the single-jet method or double-jet method, and combinations thereof.

It is preferable that the silver halide employed in the present invention comprises ions of any metal belonging to Groups 6 through 11 of the Periodic Table. Preferred as said metals are W, Fe, Co, Ni, Cu, Ru, Rh, Pd, Re, Os, Ir, Pt, and Au.

These metal ions may be incorporated into said silver halide in the form of metal complexes or metal complex ions. Preferred as said metal complexes or metal complex ions are 6-coordination metal complexes represented by the general formula described below.

$[ML_6]^m$ General Formula wherein M represents a transition metal selected from elements of Groups 6 through 11 of the Periodic Table; L represents a ligand; and m represents 0, –, 2–, 3–, or 4–. Listed as specific examples of ligands represented by L are halides (fluorides, chlorides, bromides and iodides), cyanides, cyanates, thiocyanates, selenocyanates, tellurocyanates, each ligand of azido and aquo, nitrosyl, and thionitrosyl. Of these, aquo, nitrosyl, and thionitrosyl are preferred. When said aquo ligand is present, it is preferable that one or two of said ligands are subjected to coordination. L may be the same or different.

Particularly preferred specific examples of M include rhodium (Rh), ruthenium (Ru), rhenium (Re), iridium (Ir), and osmium (Os).

Specific examples of transition metal complex ions are listed below. However, the present invention is not limited to these examples.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)_2]^{2-}$
9: $[Ru\ (NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)Cl(CN)_4]^{2-}$

14: $[Rh(NO)_2Cl_4]^-$
15: $[Rh(NO)(H_2O)Cl_4]^-$
16: $[Ru(NO)(CN)_5]^-$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^-$
22: $[Os(NS)Cl_4\ (TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or a different type of metal may be employed in combinations of two or more types. The suitable content of these metal ions, metal complexes, or metal complex ions is commonly from $1\times10^{-9}$ to $1\times10^{-2}$ mol per mol of silver halide, and is preferably from $1\times10^{-8}$ to $1\times10^{-4}$ mol.

Compounds, which provide these metals, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the nuclei formation stage, growth, and physical ripening; furthermore, are preferably added at the nuclei formation stage and growth; and are most preferably added at the nuclei formation stage.

The addition may be carried out several times by dividing the total added amount so that uniform content in the interior of a silver halide grain can be carried out. As described in Japanese Patent Publication Open to Public Inspection Nos. 63-29603, 2-306236, 3-167545, 4-76534, 6-110146, and 5-273683, incorporation can be carried out so as to result in distribution formation in the interior of the grain. It is preferable that said distribution be formed in the grain interior.

It is possible to dissolve these metal compounds in water or suitable organic solvents (for example, alcohols, ethers, glycols, ketones, esters, amides) and subsequently add the resulting solution. There are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing the three solutions; during grain formation, an aqueous solution comprising the necessary amount of a metal compound is charged into a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution.

When said addition is carried out onto the grain surface, it is possible to charge an aqueous solution comprising the necessary amount of a metal compound into a reaction vessel immediately after grain formation, or during physical ripening or at the completion thereof, or during chemical ripening.

In the invention, the photosensitive silver halide grains may not be desalted after forming the grains, but when desalting is carried out, said grains can be desalted by employing washing methods well known in the photographic art, such as a noodle method and a flocculation method.

In the present invention, except for said photosensitive silver halide grains, silver halide grains are preferably formed utilizing conversion of organic silver salts by allowing said organic silver salts to react with halogen containing compounds.

The amount of photosensitive silver halide grains prepared with above-mentioned conversion method is preferably 1.5 to 90 wt % of the total amount of photosensitive silver halide grains employed, and is more preferably 5 to 80 wt %, and is still more preferably 10 to 70 wt %.

Silver halide forming components include inorganic halogen compounds, onium halides, halogenated hydrocarbons, N-halogen compounds, and other halogen containing compounds. Specific examples include metal silver halides, and inorganic halides such as ammonium halide, for example, onium halides such as trimethylphenylammonium bromide, cetylethyldimethylammonium bromide, trimethylbenzylammonium bromide; halogenated hydrocarbons such as iodoform, bromoform, carbon tetrachloride, 2-bromo-2-methylpropane; N-halogen compounds such as N-bromosuccinic acid imide, N-bromophthalimide, and N-bromoacetoamide; others such as triphenylmethyl chloride, triphenylmethyl bromide, 2-bromoacetic acid, 2-bromoethanol, and dichlorobenzophenone.

At least one type of onium salt having a halide anion or a polyhalide anion is most preferably employed.

By onium salts is meant, according to the definition given in "McGraw-Hill Dictionary of Scientific and Technical Terms, Fourth Edition, edited by S P Parker, McGraw-Hill Book Company, New York (1989)": "chemical suffix indicating a complex cation". The halide or polyhalide onium salts, according to the present invention, may be added as solids or solutions or may be formed in the aqueous dispersion of particles of the substantially light-insensitive silver salt by metathesis between a salt with halide or polyhalide anions and onium salts with anions other than halide or polyhalide. Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred. Preferred halide anions, according to the present invention, are chloride, bromide and iodide. Preferred polyhalide anions, according to the present invention, consist of chlorine, bromine and iodine atoms. Onium cations according to the present invention, may be polymeric or non-polymeric. Suitable polymeric onium halides and polyhalides for partial conversion of particles of substantially light-insensitive organic silver salt into photo-sensitive silver halides according to the present invention are:

POLY01=a polyurethane resin 50% quaternized with ethyl bromide;

POLY02=a copolymer of 20.1 mol % of a mixture of tributyl(3-vinylbenzyl)phosphonium chloride and tributyl (4-vinylbenzyl)phosphonium chloride, 45.5 mol % of N-vinylimidazole and 34.4 mol % of acrylontrile;

POLY03=poly(2-vinylpyridine) quaternized with ethyl bromide;

POLY04=poly(2-vinylpyridine) quaternized with ethyl iodide;

POLY05=poly(4-vinylpyridine)hydrochloride

POLY06=poly(4-vinylpyridine)hydrobromide perbromide

POLY07=a copolymer of 83.5% by weight of acrylamide, 15% by weight of 4-vinylpyridine and 1.5% by weight of N-vinylimidazole quaternized with ethyl bromide;

POLY08=a copolymer of 8% by weight of styrene, 17% by weight of 4-vinylpyridine and 75% by weight of N-ethyl-4-vinylpyridinium bromide with 28% by weight of bromine;

POLY09=a copolymer of 46% by weight of styrene, 19% by weight of 4-vinylpyridine and 35% by weight of N-ethyl-4-vinylpyridinium bromide with 13% by weight of bromide;

POLY10=a copolymer of 62% by weight of styrene, 21% by weight of 4-vinylpyridine and 17% by weight of N-ethyl-4-vinylpyridinium bromide with 6.34% by weight of bromine;

POLY11=a copolymer of 77% by weight of styrene, 17% by weight of 4-vinylpyridine and 6% by weight of N-ethyl-4-vinylpyridinium bromide with 2.24% by weight of bromine.

Preferred non-polymeric onium slats for partial conversion of particles of substantially light-insensitive organic silver salt into photo-sensitive silver halides according to the present invention are:

the nitrogen-onium polyhalides (NC):

NC01=pyridinium hydrobromide perbromide

NC02=pyridinium hydrobromide

NC03=N-dodecyl-pyridinium iodide

NC04=N-hexadecyl-pyridinium bromide

NC05=.alpha.,.omega.-bis-(N-pyridinium)decane dibromide

NC06=2-(2-[1-(3-nitrophenyl)ethenyl]-N-(2-phenylethyl) pyridinium bromide

NC07=tetrabutylammonium bromide

NC08=tetrabutylammonium iodide

NC09=tetramethylammonium bromide the quaternary phosphonium polyhalides (PC):

PC01=3-(triphenyl-phosphonium)propionic acid bromide perbromide

PC02=3-(triphenyl-phosphonium)propionic acid bromide

PC03=3-(triphenyl-phosphonium)propionic acid iodide

PC04=3-(triphenyl-phosphonium)propionic acid iodide perchloride

PC05=3-(triphenyl-phosphonium)propionic acid iodide perbromide

PC06=2-(triphenyl-phosphonium)ethanol bromide

PC07=2-(triphenyl-phosphonium)ethanol chloride

PC08=methyl-triphenyl-phosphonium bromide

PC09=methyl-triphenyl-phosphonium iodide

PC10=tetraphenyl-phosphonium iodide perchloride and the ternary sulfonium polyhalide:

SC01=trimethylsulfonium iodide

The onium salts, according to the present invention, are present in quantities of between 0.1 and 35 mol % with respect to the quantity of substantially light-insensitive organic silver salt of organic, with quantities between 0.5 and 20 mol % being preferred and with quantities between 1 and 12 mol % being particularly preferred.

The photosensitive layer according to the present invention will now be described.

The heat developable photosensitive material of the present invention comprises a support having thereon at least one photosensitive layer. Said photosensitive layer may only be formed on said support. However, at least one non-photosensitive layer is preferably formed on said photosensitive layer. In order to control the amount of light transmitted through said photosensitive layer, as well as to control the wavelength distribution, a filter dye layer on the side of said photosensitive layer and/or an antihalation layer on the opposite side, a so-called backing layer, may be formed. Dyes or pigments may be incorporated into said photosensitive layer. Employed dyes may be any appropriate compounds as long as they absorb the desired light in the specified wavelength region. Preferably employed are compounds described in, for example, Japanese Patent Publication Open to Public Inspection Nos. 59-6481 and 59-182436; U.S. Pat. Nos. 4,271,263 and 4,594,312; European Patent Publication Open to Public Inspection Nos. 533,008 and 652,473; and Japanese Patent Publication Open to Public Inspection Nos. 2-216140, 4-348339, 7-191432, and 7-301890.

Said binders and matting agents are preferably incorporated into these non-photosensitive layers. Further, slipping agents such as polysiloxane compounds, waxes, and liquid paraffin may also be incorporated.

The photosensitive layer according to the present invention may be comprised of a plurality of layers. Further, in order to adjust sensitivity, a plurality of said layers may be constituted in the manner of a high sensitive layer/a low sensitive layer or a low sensitive layer/a high sensitive layer. Particularly, in the present invention, it is possible to control the grain size distribution of developed silver halide grains by incorporating photosensitive silver halides possessing different sensitivity into a plurality of photosensitive layers.

The particularly preferred embodiment is such that a photosensitive layer is constituted employing at least two layers. In this case, except that organic silver salt emulsions containing silver halide having different grain sizes are employed in each photosensitive layer, it is effective to employ organic silver salt emulsions containing grains having the same grain diameter but different sensitivity, and organic silver salt emulsions having a different number of silver halide grains.

Antifoggants employed in the present invention will now be described.

Antifoggants are preferably incorporated into the heat developable photosensitive material of the present invention. Preferred antifoggants include compounds as disclosed in U.S. Pat. Nos. 3,874,946 and 4,756,999, such as heterocyclic compounds having at least one substituent, represented by $—C(X_1)(X_2)(X_3)$ (wherein $X_1$ and $X_2$ each represent a halogen atom, and $X_3$ represents a hydrogen atom or a halogen atom). Further employed as suitable antifoggants may be compounds described in paragraph Nos. [0030] through [0036] of Japanese Patent Publication Open to Public Inspection No. 9-288328, compounds described in paragraph Nos. [0062] and [0063] of Japanese Patent Publication Open to Public Inspection No. 9-90550, and compounds disclosed in U.S. Pat. No. 5,028,523, and European Patent Nos. 600,587, 605,981, and 631,176.

The reducing agents according to the present invention will now be described.

Reducing agents are to be incorporated into the heat developable photosensitive material of the present invention. Examples of suitable reducing agents are described in U.S. Pat. Nos. 3,770,448, 3,773,512, and 3,593,862, and Research Disclosure Item Nos. 17029 and 29963, and include aminohydroxycycloalkenone compounds (for example, 2-hydroxypipiperidino-2-cyclohexane); esters of aminoreductones as the precursor of reducing agents (for example, piperidinohexose reductone monoacetate); N-hydroxyurea derivatives (for example, N-p-methylphenyl-N-hydroxyurea); hydrazones of aldehyde or ketone (for example, anthracenealdehyde phenylhydrazone); phosphoramidophenols; phosphoramidoanulines; polyhydroxybenzenes (for example, hydroquinone, t-butyl-hydroquinone, isopropylhydroquinone, and (2,5-dihydroxyphenyl) methylsulfone); sulfhyroxamic acids (for example, benzenesulfhydroxamic acid); sulfonamidoanilines (for example, 4-(N-methanesulfonamido)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides and ascorbic acid; combinations of polyhyrdroxybenzene and hydroxylamine; reductones or hydrazines; hydroxanic acids; combinations of azines and sulfonamidophenols; α-cyanophenyl acetic acid derivatives; combinations of bis-β-naphthol and 1,3-dihydroxybenzene derivatives; 5-pyrazilones; sulfonamidophenol reducing agents; 2-phenylindan-1,3-dione; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol), 1,1-bis(2-hydroxy-3,5-dimethylphenyl)-2-methylpropane, ultraviolet ray-sensitive ascorbic acid derivatives and 3-pyrazolidones. Of these, particularly preferable reducing agents are hindered phenols.

Image color control agents employed in the present inventing will now be described.

Additives designated as image color control agents, image color providing agents, or activating toners (hereinafter referred to as image color control agents) are preferably employed in the heat developable photosensitive material of the present invention, together with any of the aforesaid components. Said image color control agents relate to the oxidation-reduction reaction between organic silver salts and reducing agents, and have the function to make resulting silver images darker and specifically blacker. Suitable image color control agents employed in the present invention are disclosed. in Research Disclosure Item No. 17029 and include compounds described below.

Imides (for example, phthalimide), cyclic imides, pyrazoline-5-ones, and quinazolinone (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium or 8-methylphthalazinone and sodium p-trisulfonate sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives; benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). The preferred image color control agents are phthalazone or phthalazine.

Binders according to the present invention will now be described.

Binders suitable for the heat developable photosensitive material of the present invention are transparent or translucent, and generally colorless. Said binders include natural polymers, synthetic resins, and polymers and copolymers, as well as other film forming media; for example, gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methylmethacrylic acid), poly(vinyl chloride), poly (methacrylic acid), copoly(styrene-maleic anhydride), copoly(styrene-acrylonitrile, copoly(styrene-butadiene, poly (vinyl acetal) series (for example, poly(vinyl formal) and poly(vinyl butyral), poly(ester) series, poly(urethane) series, phenoxy resins, poly(vinylidene chloride), poly(epoxide) series, poly(carbonate) series, poly(vinyl acetate) series, cellulose esters, and poly(amide) series. These may be hydrophilic or hydrophobic.

Further, to protect the surface of photosensitive materials and to minimize abrasion, it is possible to provide a non-photosensitive layer on the exterior side of the photosensitive layer. Types of binders used for said non-photosensitive layer may be the same as those used for the photosensitive layer or different from those used for the photosensitive layer.

In the present invention, in order to enhance the heat development rate, the amount of binders in a photosensitive layer is preferably from 1.5 to 10 g/m$^2$, and is more preferably from 1.7 to 8 g/m$^2$. When the amount is less than 1.5 g/m$^2$, the density of unexposed areas markedly increases to occasionally result in commercial non-viability.

Cross-linking agents (hereinafter occasionally referred to as hardening agents) related to the present invention will now be described.

Employed as cross-linking agents, employed in the present invention, may be various cross-linking agents which have been conventionally used in photographic materials. For example, it is possible to employ aldehyde based, epoxy based, ethyleneimine based, vinylsulfone based, sulfonic acid ester based, acryloyl based, and carbodiimido based cross-linking agents. Preferably employed are isocyanate based compounds, epoxy compounds, and acid anhydrides.

Further, it is possible to preferably employ silane compounds represented by general formula (1) or general formula (2) disclosed in Japanese Patent Application No. 12-077904.

Sensitizing dyes employed in the present invention will now be described.

In the heat developable photosensitive material of the present invention, it is possible to use sensitizing dyes described in, for example, Japanese Patent Publication Open to Public Inspection Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes employed in the present invention are described in, for example, publications described in Research Disclosure Item No. 17643, Section IV-A (page 23, November 1978), and the references cited therein. Particularly, selected can advantageously be sensitizing dyes having a spectral sensitivity suitable for spectral characteristics of light sources of various types of scanners. For example, preferably employed for an argon-neon laser beam source are simple merocyanines, described in Japanese Patent Publication Open to Public Inspection Nos. 60-162247 and 2-48635; U.S. Pat. No. 2,161,331; West German Patent No. 936017; and Japanese Patent Publication Open to Public Inspection No. 5-11389; preferably employed for a helium-neon laser beam source are trinuclear cyanine dyes shown in Japanese Patent Publication Open to Public Inspection Nos. 50-62425, 54-18726, and 59-102229, as well as merocyanines described in Japanese Patent Publication Open to Public Inspection No. 7-287338; preferably employed for an LED light source as well as an infrared semiconductor laser beam source are thiacarbocyanines described in Japanese Patent Publication Nos. 48-42172, 51-9609, and 55-39818, and Japanese Patent Publication Open to Public Inspection Nos. 62-284343 and 2-105135; preferably employed for an infrared semiconductor laser beam source are tricarbocyanines described in Japanese Patent Publication Open to Public Inspection Nos. 59-191032 and 60-80841, tricarbocyanines described in Japanese Patent Publication Open to Public Inspection No. 60-80841, and carbocyanines containing 4-quinoline nucleus, represented by general formulas (IIIa) and (IIIb) described in Japanese Patent Publication Open to Public Inspection Nos. 59-191032 and 3-67242. Further, when the wavelength of said infrared laser beam source is at least 750 nm, and is preferably at east 800 nm, preferably employed for laser beams in such a wavelength region are sensitizing dyes described in Japanese Patent Publication Open to Public Inspection Nos. 4-182639 and 5-341432; Japanese Patent Publication 6-52387 and 3-10931; U.S. Pat. No. 5,441,866; and Japanese Patent Publication Open to Public Inspection No. 7-13295. These sensitizing dyes may be employed individually. However, these sensitizing dyes, in combination, are often employed to achieve supersensitization. Compounds, which exhibit no spectral sensitizing function or do not basically absorb visible light, but do exhibit supersensitization, may be incorporated into an emulsion along with sensitizing dyes.

Chemical sensitization, as employed in the present invention, will now be described.

Silver halide grains according to the present invention may undergo chemical sensitization. For example, it is possible to form and provide chemical sensitization centers (or chemical sensitization specks), employing compounds which release chalcogens such as sulfur, or noble metal ions such as gold ions, employing the methods described in Japanese Patent Application Nos. 12-57004 and 12-61942.

In the present invention, it is preferable that said chemical sensitization be carried out employing organic sensitizers comprising chalcogen atoms as described below.

Said organic sensitizers comprising a chalcogen atom are preferably compounds having a substituent which is adsorbable onto silver halide as well as having an unstable chalcogen atom position.

Employed as said organic sensitizers may be those having various structures disclosed in Japanese Patent Publication Open to Public Inspection Nos. 60-150046, 4-109240, and 11-218874. Of these, the preferred compound is one of those having the structure in which said chalcogen atom is bonded to either a carbon atom or a phosphor atom through a double bond.

In the present invention, the amount of chalcogen compounds used as the organic sensitizer varies depending on the employed chalcogen compounds, the silver halide grains, and the reaction environments during chemical sensitization, but is preferably from $10^{-8}$ to $10^{-2}$ mol per mol of silver halide, and is more preferably from $10^{-7}$ to $10^{-3}$ mol. The chemical sensitization environments in the present invention are not particularly limited. In the presence of compounds capable of eliminating chalcogenized silver or silver specks on silver halide grains or reduce the size thereof, or in the presence of oxidizing agents capable of particularly oxidizing silver specks together with said compounds, it is preferable to carry out said chalcogen sensitization, employing organic sensitizers containing chalcogen atoms. As said sensitization conditions, the pAg is preferably from 6 to 11, and is more preferably from 7 to 10, while the pH is preferably from 4 to 10, is more preferably from 5 to 8, and is still more preferably 5 to 8. Further, said sensitization is preferably carried out at a temperature of 30° C. or lower.

Accordingly, in the silver salt photothermographic dry imaging material of the present invention, it is preferable to employ a photosensitive emulsion which is prepared in the following manner. Said photosensitive silver halide undergoes chemical sensitization at 30° C. or lower, employing organic sensitizers containing chalcogen atoms together with oxidizing agents capable of oxidizing silver specks on said grains. Subsequently, the sensitized silver halide is mixed with organic silver salts, and the resulting mixture is dispersed, followed by dehydration and drying.

Further, it is preferable that chemical sensitization, employing these organic sensitizers, be carried out in the presence of heteroatoms containing compounds which are absorbable to spectral sensitizing dyes or silver halide grains. By carrying out said process in the presence of compounds which are adsorbable onto silver halide, it is possible to minimize the dispersion of chemical sensitization center nuclei whereby it is possible to achieve high sensitively as well as low fogging. Though spectral sensitizing dyes employed in the present invention are described later, listed as heteroatom containing compounds, as described herein, are nitrogen containing heterocyclic compounds described in Japanese Patent Publication Open to Public Inspection No. 3-24537 as the preferred examples. In the nitrogen containing heterocylic compounds employed in the present invention, listed as heterocyclic rings are a pyrazole ring, a pyrimidine ring, a 1,2,4-triazile ring, a 1,2,3-triazole ring, a 1,3,4-thiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a ring in which 2 to 3 rings thereof are bonded to each other such as a triazolotriazole ring, a diazaindene ring, a triazaindenes ring, and a pentaazaindene ring. It is also possible to employ heterocyclic rings, which are formed by condensing a single heterocyclic ring with an aromatic ring, for example, a phthalazine ring, a benzimidazole ring, an indazole ring, and a benzthiazole ring.

Of these, an azaindene ring is preferred, but azaindene compounds having a hydroxy group as the substituent, such as hydroxytriazaindene, tetrahydroxyazaindene, and hydroxypentaazaindene are more preferred.

Said heterocyclic ring may have substituents other than a hydroxy group, and may have, as the substituent, for example, an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom, and a cyano group.

The added amount of said heterocyclic ring containing compounds varies widely depending on the size and composition of silver halide grains, and other conditions, but is in the range of about $10^{-6}$ to about 1 mol per mole of silver halide, and is preferably in the range of $10^{-4}$ to $10^{-1}$.

As noted above, silver halide grains according to the present invention may undergo noble metal sensitization, utilizing compounds releasing noble metal ions such as gold ions. For example, employed as gold sensitizers may be chloroauric acid salts and organic gold compounds.

Further, other than said sensitization method, it is possible to employ a reduction sensitization method. Specific examples of compounds, which may also be employed for said reduction sensitization, include ascorbic acid, thiourea dioxide, stannous chloride, hydrazine derivatives, borane compounds, silane compounds, and polyamine compounds. Further, an emulsion may undergo reduction sensitization while maintaining the pH at 7 or higher and the pAg at no more than 8.3.

The silver halide according to the present invention, which undergo chemical sensitization may be formed under conditions in the presence of organic silver salts or without organic silver salts, or may be formed employing a mixture thereof.

Coatings employed to prepare the heat developable photosensitive material of the present invention will now be described.

All coating compositions employed to prepare the heat developable photosensitive material of the present invention are preferably filtered prior to coating. Said filtration is preferably carried out while passing at least once through a filter medium having an absolute or semi-absolute filtration accuracy of 5 to 50 $\mu$m.

A successive multilayer coating system, in which coating and drying each layer is repeated, is listed for applying the coating compositions of the heat developable photosensitive material of the present invention. Said systems include roll coating systems such as reverse roll coating and gravure roll coating, a blade coating system, a wire bar coating system, and a die coating system. Further, by employing a plurality of coaters, each of said coating compositions may be coated before complete drying of the previous coating, and the plurality of layers is simultaneously dried. Still further, a simultaneous multilayer coating system may be employed by utilizing slide coating, curtain coating, or an extrusion type die coater, in which a plurality of layers are laminated and then coated. Of these, said simultaneous multilayer coating system is preferred because it is possible to minimize coating problems due to foreign matter brought into a coating area from the exterior. Further, when said simultaneous multilayer coating is employed, it is preferable that, during coating, the viscosity of the coating composition of the outermost layer is adjusted to 0.1 Pa·s or higher and the viscosity of the coating compositions of other layers is adjusted to 0.3 Pa·s or lower so that mixing between each of layers is minimized.

Further, when the coating composition of each layer, comprising dissolved solids, is laminated, said solids which are insoluble or barely soluble in the organic solvent in the adjacent layer, they tend to be deposited in the interface to result in non-uniform coating or turbidity. Accordingly, it is preferable that the organic solvent, which is contained in each layer in the largest amount, is identical to the other layers (the content of the organic solvent which is contained in all coating compositions is to be larger than other solvents).

After multilayer coating, it is preferable that the resulting coating be dried as soon as possible. In order to avoid mixing between layers due to flow, diffusion, and density difference, the resulting coating preferably reaches a drying process within 10 seconds. Employed as drying systems are a hot-air drying system and an infrared ray drying system. of these, said hot-air drying system is particularly preferred. In said hot-air dying system, drying temperatures are preferably from 30 to 100° C.

Immediately after drying, the heat developable photosensitive material of the present invention may be cut into the specified size and packaged, or may be wound into a roll and stored before cutting and packaging. Winding systems are not particularly limited, but tension control winding is commonly employed.

The exposure method according to the present invention will now be described.

In the present invention, exposure is preferably carried out employing a laser scanning beam. Further, it is preferable to employ a laser scanning exposure device in which the angle between the exposure surface of the material to be exposed and the scanning laser beam is substantially not perpendicular.

"Is substantially not perpendicular", as described herein, means that during laser scanning, the angle approaches perpendicularity preferably from 55 to 88 degrees, more preferably from 60 to 86 degrees, still more preferably from 65 to 84 degrees, and most preferably from 70 to 82 degrees.

When a laser beam scans a photosensitive material, the beam spot diameter on the exposure surface of said photosensitive material is preferably no more than 200 $\mu$m, and is more preferably no more than 100 $\mu$m. When said spot diameter decreases, it is possible to preferably decrease the deviated angle of the incident laser beam from perpendicularity. Incidentally, the lower limit of said beam spot diameter is 10 $\mu$m. By employing said laser scanning exposure, it is possible to minimize image degradation due to reflected light such as the formation of interference fringe-shaped unevenness.

Further, exposure in the present invention is preferably carried out employing a laser scanning exposure device which emits a longitudinal multi scanning laser beam, which minimizes the degradation of image quality such as the formation of interference fringe-shaped unevenness, compared to a lateral single mode scanning laser beam.

In order to be subjected to longitudinal multi scanning, methods such as the use of a multiplex wave, the use of return light, and applying high frequency superposition are preferably employed. Incidentally, the longitudinal multi scanning, as described herein, means that the wavelength of exposure light is not a single wavelength. The wavelength distribution of the exposure light is generally at least 5 nm, and is preferably at least 10 nm. The upper limit of the wavelength distribution of the exposure light is not particularly limited, but it is generally about 60 nm.

Heat development employed in the image forming method of the present invention will now be described.

The heat developable photosensitive material of the present invention is stable at normal temperature, but after exposure, and when heated to a relatively high temperature, said material is developed. The heating temperature is preferably from 80 to 200° C., and is more preferably from 100 to 150° C. When said heating temperature is 80° C. or lower, sufficient image density is not obtained during a short period of time. On the other hand, when the heating temperature is 200° C. or higher, images themselves as well as conveying properties and a processor are adversely affected such as transfer of melted binders onto rollers. Through heating, oxidation-reduction reaction occurs between organic silver salts (which function as the oxidizing agent) and reducing agents, whereby silver images are formed. This reaction process proceeds without supply of any processing solution, such as water, from the exterior.

EXAMPLES

The present invention will now be described with reference to the examples. However, the present invention is not limited to these examples. In the examples, "percent" is "percent by weight" unless otherwise specified. Further, "concentration in mol/L" is expressed by "M".

Example 1

Preparation of Photosensitive Silver Halide Emulsion 1

Composition of Solution (A1)

| | |
|---|---|
| Phenylcarbamoy gelatin (average molecular weight of 100,000) | 88.3 g |
| Compound (A) (10 percent methanol solution) | 10 ml |
| Potassium bromide | 0.32 g |
| Water to make | 5429 ml. |

Composition of Solution (B1)

| | |
|---|---|
| 0.67 mol/liter aqueous silver nitrate solution | 2635 ml |

Composition of Solution (C1)

| | |
|---|---|
| Potassium bromide | 51.55 g |
| Potassium iodide | 1.47 g |
| Water to make | 660 ml. |

Composition of Solution of (D1)

| | |
|---|---|
| Potassium bromide | 154.9 g |
| Potassium iodide | 4.41 g |
| Iridium chloride (1 percent solution) | 0.93 ml |

Composition of Solution (E1)

| | |
|---|---|
| 0.4 mol/liter aqueous potassium bromide solution | an amount for controlling later mentioned silver potential |

Composition of Solution (F1)

| | |
|---|---|
| 56 percent aqueous acetic acid solution | 16.0 ml |

Composition of Solution (G1)

| | |
|---|---|
| Sodium carbonate anhydrous | 1.72 g |
| Water to make | 151 ml |

Compound (A): $HO(CH_2CH_2O)_n—[CH(CH_3)CH_2O]_{17}—(CH_2CH_2O)_mH$ m+n=5 to 7

Employing a mixing stirrer described in Japanese Patent Publication No. 58-58288 and 58-58289, added to Solution (A1) were ¼ Solution (B1) and total Solution (C1) over 4 minutes 45 seconds utilizing a double-jet method, while adjusting the temperature to 45° C. and the pAg to 8.09, whereby nuclei were formed.

After 7 minutes, added to the resulting, mixture were the residual Solution (B1) and all of Solution (D1) over 14 minutes 15 seconds employing a double-jet method, while adjusting the temperature to 45° C., and the pAg to 8.09 employing Solution (E1). During mixing, the pH of the reaction solution was 5.6.

After said solution was stirred for 5 minutes, it was cooled to 40° C. Subsequently, added to the resulting solution was all of Solution (F1), whereby a silver halide emulsion was precipitated. The resulting supernatant was then removed while leaving 2,000 ml of the resulting precipitation to which 10 liters of water was added. After stirring, silver halide was precipitated. Subsequently, the resulting supernatant was removed while leaving 1,500 ml of the precipitation. Thereafter, Solution (G1) was added and the resulting mixture was heated to 60° C. and stirred for a further 120 minutes. Finally, the pH was adjusted to 5.8 and water was added so as to obtain a total weight of 1,161 g per mol of silver, whereby Photosensitive Emulsion 1 was prepared. Said Emulsion 1 was comprised of cubic silver iodobromide grains having an average grain size of 0.058 μm, a variation coefficient of grain size of 12 percent, and a [100] plane ratio of 92 percent.

Preparation of Photosensitive Silver Halide Emulsion 2

Photosensitive Silver Halide Emulsion 2 was prepared in the same manner as Photosensitive Silver Halide Emulsion 1, except that the solution temperature was varied to 25° C. The resulting Emulsion 2 was comprised of cubic silver iodobromide grains having an average grain size of 0.040 μm, a variation coefficient of grain size of 12 percent, and a [100] plane ratio of 93 percent.

Preparation of Powdered Organic Silver Salt 1

Dissolved in 4,720 ml of pure water were 130.8 g of behenic acid, 67.7 g of arachidinic acid, 43.6 g of stearic acid and 2.3 g of palmitic acid at 80° C. Subsequently, added to the resulting mixture were added 540.2 ml of a 1.5 M aqueous sodium hydroxide solution and 6.9 ml of concentrated nitric acid, and the resulting mixture was then cooled to 55° C., whereby a sodium organic acid salt solution was prepared. While maintaining the temperature of said fatty acid sodium salt solution at 55° C., 45.3 g of said Photosensitive Silver Halide Emulsion 1 and 450 ml of pure water were added and stirred for 5 minutes.

Subsequently, 702.6 ml of 1 M silver nitrate solution were added over 2 minutes and the resulting mixture was stirred for 10 minutes, whereby an organic silver salt dispersion was prepared. Thereafter, the prepared organic silver salt dispersion was placed into a washing vessel. After adding deionized water while stirring, the resulting dispersion was allowed to stand so that the organic silver salt dispersion was separated as the supernatant and water-soluble salts below the supernatant were removed. The supernatant organic silver salt dispersion was repeatedly washed with deionized water and drained until the electric conductivity of the drainage reached 2 $\mu$S/cm, and then dehydrated by centrifuge. The resulting organic silver salt dispersion was dried employing a warm-air circulating dryer at 40° C. until no decrease in weight was noticed, whereby Powdered Organic Silver Salt 1 was prepared.

Preparation of Powdered Organic Silver Salt 2

Powdered Organic Silver Salt 2 was prepared in the same manner as Powdered Organic Silver Salt 1, except that 90.6 g of Photosensitive Silver halide Emulsion 1 were added.

Preparation of Powdered Organic Silver Salt 3

Powdered Organic Silver Salt 3 was prepared in the same manner as Powdered Organic Silver Salt 1, except that Photosensitive Silver halide Emulsion 1 was replaced with Photosensitive Silver halide Emulsion 2.

Preparation of Preliminary Dispersion

Dissolved in 1,457 g of methyl ethyl ketone were 14.57 g of polyvinylbutyral powder (Esrec BL-5, produced by Sekisui Kagaku Co.). Subsequently, Preliminary Dispersion 1 was prepared by gradually adding 500 g of Powdered Organic Silver Salt 1 while sufficiently stirred employing a dissolver, DISPERMAT Type CA-40M, produced by VMA-Getzmann Co.

Preliminary Dispersions 2 and 3 were prepared in the same manner as above, employing Powdered Organic Silver Salts 2 and 3.

Preparation of Photosensitive Emulsion

By employing a pump, Preliminary Dispersion 1 was supplied into a media type homogenizer, Dispermat Type SL-C12EX, filled with 0.5 mm diameter zirconia beads in an amount of 80 percent of the interior volume, so as to obtain a retention time in the mill of 10 minutes, and was dispersed at a circumferential speed of the mill of 13 m/second, whereby Photosensitive Dispersion 1 was prepared.

Photosensitive Emulsions 2 and 3 were prepared in the same manner as above, employing Preliminary Dispersions 2 and 3.

Preparation of Stabilizer Solution

A stabilizer solution was prepared by dissolving 1.0 g of Stabilizer 1 and 0.31 g of potassium acetate in 4.97 g of methanol.

Preparation of Infrared Sensitizing Dye Solution

An infrared sensitizing dye solution was prepared by dissolving in a dark place 19.2 mg of Infrared Sensitizing Dye 1, 1.4.88 g of 2-chloro-benzoic acid, and 2.779 g of Stabilizer 2 in 31.3 ml of MEK.

Preparation of Supersensitizer Solution

A supersensitizer solution was prepared by dissolving 50.1 mg of Supersensitizer 1 in 30.3 ml of methanol.

Preparation of Additive Solution "a"

Additive Solution "a" was prepared by dissolving 27.98 g of 1-bis(2-hydroxy-3,5-dimethylphenyl)-2-methylpropane (Reducing Agent A-3), 1.54 g of methylphthalic acid, and 0.48 g of Infrared Dye 1 in 110 g of MEK.

Preparation of Additive Solution "b"

Additive Solution "b" was prepared by dissolving 3.56 g of Antifoggant 2 and 3.43 g of phthalazine in 40.9 g of MEK.

Preparation of Photosensitive Layer Coating Composition 1-1

While stirring under an inert gas atmosphere (comprising 97 percent nitrogen gas), 15.11 g of MEK were added to said Photosensitive Emulsion 1 (50 g) while heating to 25° C., and 390 $\mu$l of Antifoggant 1 (10 percent methanol solution) were added, followed by stirring for 1 hour 20 minutes. Further, 167 ml of said stabilizer solution was added and stirred for 10 minutes. Subsequently, 1.32 g of said infrared sensitizing dye solution was added and stirred for one hour. Thereafter, the resulting mixture was cooled to 13° C. and stirred a further 25 minutes. While maintaining at 13° C., 0.67 g of said supersensitizer solution was added and stirred for 5 minutes. Subsequently, 13.31 g of polyvinyl butyral (Esrec BL-5, manufactured by Sekisui Kagaku Co.) were added and stirred for 30 minutes. Thereafter, 1.084 g of tetrachlorophthalic acid (being a 9.4 weigh percent MEK solution) were added and stirred for 15 minutes. Further, while stirring, 12.43 g of Additive Solution "a", 1.6 ml of Desmodur N3300/aliphatic isocyanate, manufactured by Mobay Co. (being a 10 percent MEK solution), and 4.27 9 of Additive Solution "b" were successively added and stirred, whereby Photosensitive Layer Coating Composition 1-1 was prepared.

Preparation of Photosensitive Layer Coating Composition 1-2

Photosensitive Layer Coating Composition 1-2 was prepared in the same manner as Photosensitive Layer Coating Composition 1-1, except that 494 $\mu$l of potassium bromide (being a 10 percent methanol solution) were added one hour after adding Antifoggant 1, and subsequently Stabilizer Solution was added 20 minutes after said addition.

Preparation of Photosensitive Layer Coating Composition 1-3

Photosensitive Layer Coating Composition 1-3 was prepared in the same manner as Photosensitive Layer Coating Composition 1-2, except that calcium bromide was replaced with 3-(triphenylphosphomium)propionic acid bromide in an equal amount of mol.

Preparation of Photosensitive Layer Coating Composition 1-4

Photosensitive Layer Coating Composition 1-4 was prepared in the same manner as Photosensitive Layer Coating Composition 1-2, except that said calcium bromide was replaced with pyridinium hydrobromide.

Preparation of Photosensitive Layer Coating Composition 1-5

Photosensitive Layer Coating Composition 1-5 was prepared in the same manner as Photosensitive Layer Coating Composition 1-2, except that Chemical Sensitizer 1 in an amount of 0.3 mol/mol of silver was added 30 minutes before adding Antifoggant 1.

Preparation of Photosensitive Layer Coating Compositions 2-1 through 3-5

Regarding Photosensitive Emulsions 2 and 3, Photosensitive Layer Coating Compositions 2-1 through 3-5 were prepared in the same manner as Photosensitive Layer Coating Compositions 1-1 through 3-5.

Preparation of Matting Agent

A matting agent dispersion was prepared as described below. Dissolved in 42.5 g of MEK was 7.5 g cellulose acetate butyrate (CAB 171-15, manufactured by Eastman Chemical Co.), followed by the addition of 5 g of calcium carbonate (Super-Pflex 200, manufactured by Speciality Minerals Co.). The resulting mixture was then dispersed at 8,000 rpm for 30 minutes, employing a dissolver type homogenizer.

Preparation of the Surface Protective Layer Coating Composition

While stirring, added to and dissolved in 865 g of MEK (methyl ethyl ketone) were 96 g of cellulose acetate butyrate (CAB 171-15, manufactured by Eastman Chemical Co.), 4.5 g of polymethylmethacrylic acid (Palaroid A-21, manufactured by Rhom & Haas Co.), 1.5 g of a vinylslufone compound (HD-1), 1.0 g of benzotriazole, 1.0 g of F based surface active agent (Surfron KH40, manufactured by Asahi Glass Co.). Subsequently, 30 g of said matting agent dispersion were added to the resulting solution, whereby a surface protective layer coating composition was prepared.

Infrared Dye 1

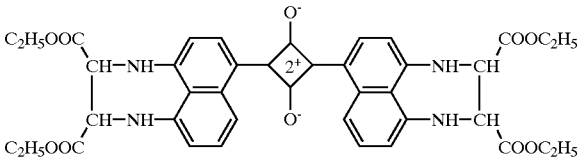

Chemical Sensitizer 1

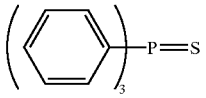

Supersensitizer 1

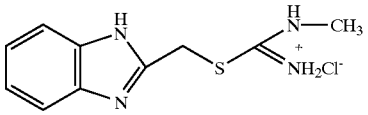

Stabilizer 1

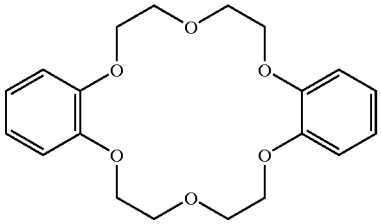

Antifoggant 1

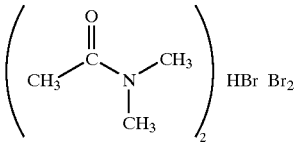

Stabilizer 2

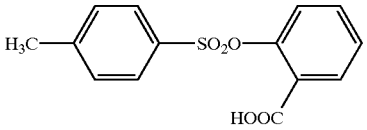

Antifoggant 2

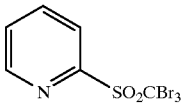

Vinylsulfone Compound (HD-1)

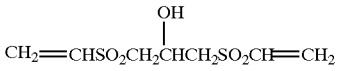

Infrared Sensitizing Dye 1

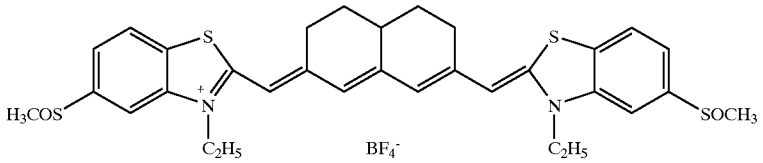

<<Coating>>

By adjusting the amount of solvents, the viscosity of the aforesaid photosensitive layer coating composition and surface protective layer coating composition was adjusted to 0.228 Pa·s and 0.184 Pa·s, respectively. After filtering these coating compositions, employing a filer having an absolute filtration accuracy of 20 $\mu$m, the filtered coating compositions were extruded from the slit of an extrusion type die coater, laminated, and simultaneously coated onto a support, while employing each of the photosensitive layer coating compositions and silver coated amounts shown in Tables 1 and 2. Eight seconds after coating, the resulting coating was dried for 5 minutes, employing 75° C. hot air at a dew point temperature of 10° C. Thereafter, the resulting coating was wound into a roll at a tension of 196 N/m under an ambience of 23° C. and 50 percent relative humidity, whereby a photosensitive material was prepared. The thickness of the surface protective layer of the obtained photosensitive material was adjusted so as to become 2.5 $\mu$m after drying.

<<Sensitometry>>

Said coated samples were cut to 3.5 cm×15.0 cm. Each of said cut samples was exposed, employing a laser sensitometer provided with an 810 nm diode, and processed (developed) at 120° C. for 15 seconds. Obtained images were evaluated employing a densitometer. Dmin, sensitivity (being the reciprocal of the exposure amount which results in density higher than Dmin plus 1.0), and Dmax were determined. Then relative sensitivity was obtained when the sensitivity of Sample No. 1 was 100. Tables 1 and 2 show the results.

Further, each sample was evaluated as described below.

<<Storage Stability>>

After storing said coated samples at the conditions described below for 10 days, each of the resulting samples was exposed and developed at conditions previously described. Each of the obtained images was evaluated employing a densitometer. The difference in Dmin between Condition A and Condition B (Dmin(B)−Dmin(A)) was obtained and designated as "storage stability". Tables 1 and 2 show the results. Condition A: 25° C. and 55 percent relative humidity Condition B: 40° C. and 80 percent relative humidity <<Image Retention Quality>>

One of two samples, which were processed in the same manner as in sensitometry, was stored at 25° C. and 55 percent relative humidity for 7 days under subdued light, while the other was exposed to natural light at identical conditions for 7 days. Thereafter, the density of fogged areas on both resulting samples was determined. Tables 1 and 2 show the results.

Said image retention quality was evaluated based on increase in fog, equaling fog when exposed to natural light minus fog when stored under subdued light.

<<Silver Image Color>>

In order to evaluate silver image color, a sample at density of 1.1±0.05 after development was prepared through adjusting the exposure amount. Said sample was irradiated under light having a color temperature of 7,700 Kelvin and an illuminance of 11,600 lux for 100 and 1,000 hours. Subsequently, the resulting silver image color was evaluated based on the criteria described below. Rank 4 or higher resulted in no problems in terms of quality assurance.

Evaluation Criteria

5: pure black without any noticeable yellow tint
4: not pure black, but noticing almost no yellow tint
3: slightly noticed partial yellow tint
2: easily noticed overall yellow tint
1: noticing of yellow tint at first sight.

Tables 1 and 2 show the obtained results.

Ratio (*) in Tables 1 to 4 means a value of $N_1/(N_1+N_2)$.

TABLE 1

| Sample No. | Used Coating Composition No. | Coated Silver Amount (g/m$^2$) | Developed Silver Halide Grains Number (× $10^3$ grains/m$^2$) | Ratio (*) | Sensitometry Fog | Sensitivity | Dmax | Storage Stability | Image Retention Quality | Silver Image Color | Remarks |
|---|---|---|---|---|---|---|---|---|---|---|---|
| 1 | 1-1 | 2.1 | 10 | 65% | 0.32 | 100 | 3.2 | 0.13 | 0.25 | 3 | Comp. |
| 2 | | 1.8 | 9 | 65% | 0.30 | 95 | 2.8 | 0.10 | 0.23 | 3 | Comp. |
| 3 | | 1.2 | 6 | 65% | 0.21 | 80 | 1.8 | 0.05 | 0.20 | 3 | Comp. |
| 4 | | 0.5 | 2 | 65% | 0.18 | 50 | 0.8 | 0.02 | 0.15 | 3 | Comp. |
| 5 | | 0.2 | 1 | 65% | 0.15 | 30 | 0.3 | 0.02 | 0.06 | 3 | Comp. |
| 6 | 1-2 | 2.1 | 12 | 80% | 0.32 | 110 | 3.6 | 0.13 | 0.20 | 2 | Comp. |
| 7 | | 1.8 | 1 | 80% | 0.18 | 110 | 3.7 | 0.02 | 0.01 | 4 | Inv. |
| 8 | | 1.2 | 7 | 80% | 0.15 | 100 | 3.5 | 0.02 | 0.01 | 4 | Inv. |
| 9 | | 0.5 | 3 | 80% | 0.15 | 50 | 1.4 | 0.02 | 0.01 | 3 | Comp. |
| 10 | | 0.2 | 1 | 80% | 0.14 | 30 | 0.5 | 0.01 | 0.01 | 3 | Comp. |
| 11 | 1-3 | 2.1 | 14 | 90% | 0.32 | 100 | 3.5 | 0.10 | 0.21 | 2 | Comp. |
| 12 | | 1.8 | 12 | 90% | 0.18 | 120 | 3.8 | 0.01 | 0.01 | 4 | Inv. |
| 13 | | 1.2 | 8 | 90% | 0.15 | 110 | 3.6 | 0.01 | 0.01 | 4 | Inv. |
| 14 | | 0.5 | 3 | 90% | 0.15 | 80 | 1.8 | 0.01 | 0.01 | 3 | Comp. |

TABLE 1-continued

| Sample No. | Used Coating Composition No. | Coated Silver Amount (g/m²) | Developed Silver Halide Grains Number (× 10³ grains/m²) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 15 | | 0.2 | 1 | 90% | 0.15 | 50 | 0.6 | 0.01 | 0.01 | 3 | Comp. |
| 16 | 1-4 | 2.1 | 14 | 90% | 0.32 | 105 | 3.5 | 0.10 | 0.2 | 2 | Comp. |
| 17 | | 1.8 | 12 | 90% | 0.15 | 125 | 3.8 | 0.01 | 0.01 | 4 | Inv. |
| 18 | | 1.2 | 8 | 90% | 0.15 | 120 | 3.6 | 0.01 | 0.01 | 4 | Inv. |
| 19 | | 0.5 | 3 | 90% | 0.15 | 80 | 1.8 | 0.01 | 0.01 | 3 | Comp. |
| 20 | | 0.2 | 1 | 90% | 0.15 | 60 | 0.6 | 0.01 | 0.01 | 3 | Comp. |
| 21 | 1-5 | 2.1 | 15 | 100% | 0.32 | 150 | 3.2 | 0.52 | 0.85 | 2 | Comp. |
| 22 | | 1.8 | 13 | 100% | 0.30 | 130 | 2.8 | 0.50 | 0.80 | 2 | Comp. |
| 23 | | 1.2 | 9 | 100% | 0.28 | 80 | 1.8 | 0.25 | 0.70 | 2 | Comp. |
| 24 | | 0.5 | 4 | 100% | 0.25 | 50 | 0.8 | 0.20 | 0.55 | 3 | Comp. |
| 25 | | 0.2 | 1 | 100% | 0.21 | 20 | 0.3 | 0.13 | 0.30 | 3 | Comp. |
| 26 | 2-1 | 2.1 | 13 | 50% | 0.35 | 100 | 3.5 | 0.14 | 0.23 | 2 | Comp. |
| 27 | | 1.8 | 12 | 50% | 0.32 | 90 | 3.0 | 0.10 | 0.20 | 2 | Comp. |
| 28 | | 1.2 | 8 | 50% | 0.30 | 80 | 2.0 | 0.06 | 0.15 | 2 | Comp. |
| 29 | | 0.5 | 3 | 50% | 0.28 | 50 | 1.0 | 0.03 | 0.10 | 2 | Comp. |
| 30 | | 0.2 | 1 | 50% | 0.25 | 35 | 0.5 | 0.03 | 0.08 | 2 | Comp. |
| 31 | 2-2 | 2.1 | 17 | 65% | 0.35 | 110 | 3.5 | 0.12 | 0.25 | 2 | Comp. |
| 32 | | 1.8 | 15 | 65% | 0.33 | 100 | 3.0 | 0.10 | 0.20 | 2 | Comp. |
| 33 | | 1.2 | 10 | 65% | 0.30 | 60 | 2.0 | 0.06 | 0.15 | 2 | Comp. |
| 34 | | 0.5 | 4 | 65% | 0.28 | 40 | 1.0 | 0.03 | 0.10 | 2 | Comp. |
| 35 | | 0.2 | 2 | 65% | 0.25 | 20 | 0.5 | 0.02 | 0.08 | 2 | Comp. |
| 36 | 2-3 | 2.1 | 20 | 75% | 0.35 | 120 | 3.5 | 0.10 | 0.15 | 2 | Comp. |
| 37 | | 1.8 | 17 | 75% | 0.15 | 120 | 3.5 | 0.02 | 0.01 | 4 | Inv. |
| 38 | | 1.2 | 12 | 75% | 0.15 | 115 | 3.3 | 0.02 | 0.01 | 4 | Inv. |
| 39 | | 0.5 | 5 | 75% | 0.15 | 70 | 1.6 | 0.02 | 0.01 | 3 | Inv. |
| 40 | | 0.2 | 2 | 75% | 0.13 | 50 | 0.7 | 0.02 | 0.01 | 3 | Comp. |

TABLE 2

| Sample No. | Used Coating Composition No. | Coated Silver Amount (g/m²) | Developed Silver Halide Grains Number (× 10³ grains/m²) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 41 | 2-4 | 2.1 | 20 | 75% | 0.35 | 120 | 3.5 | 0.13 | 0.20 | 2 | Comp. |
| 42 | | 1.8 | 17 | 75% | 0.15 | 120 | 3.5 | 0.02 | 0.01 | 4 | Inv. |
| 43 | | 1.2 | 12 | 75% | 0*15 | 110 | 3.3 | 0.02 | 0.01 | 5 | Inv. |
| 44 | | 0.5 | 5 | 75% | 0.13 | 80 | 1.6 | 0.02 | 0.01 | 3 | Inv. |
| 45 | | 0.2 | 2 | 75% | 0.12 | 60 | 0.7 | 0.02 | 0.01 | 3 | Comp. |
| 46 | 2-5 | 2.1 | 24 | 90% | 0.32 | 160 | 3.5 | 0.40 | 0.35 | 2 | Comp. |
| 47 | | 1.8 | 21 | 90% | 0.15 | 155 | 3.5 | 0.04 | 0.03 | 4 | Inv. |
| 48 | | 1.2 | 14 | 90% | 0.15 | 110 | 3.4 | 0.04 | 0.03 | 5 | Inv. |
| 49 | | 0.5 | 6 | 90% | 0.13 | 95 | 3.0 | 0.03 | 0.02 | 5 | Inv. |
| 50 | | 0.2 | 2 | 90% | 0.12 | 40 | 1.5 | 0.03 | 0.01 | 3 | Comp. |
| 51 | 3-1 | 2.1 | 26 | 55% | 0.35 | 100 | 3.1 | 0.25 | 0.15 | 1 | Comp. |
| 52 | | 1.8 | 22 | 55% | 0.33 | 95 | 2.7 | 0.23 | 0.13 | 1 | Comp. |
| 53 | | 1.2 | 15 | 55% | 0.31 | 80 | 1.8 | 0.20 | 0.08 | 1 | Comp. |
| 54 | | 0.5 | 6 | 55% | 0.30 | 45 | 0.7 | 0.18 | 0.04 | 1 | Comp. |
| 55 | | 0.2 | 2 | 55% | 0.28 | 30 | 0.2 | 0.15 | 0.02 | 1 | Comp. |
| 56 | 3-2 | 2.1 | 33 | 70% | 0.35 | 110 | 3.5 | 0.12 | 0.13 | 2 | Comp. |
| 57 | | 1.8 | 28 | 70% | 0.18 | 105 | 3.4 | 0.01 | 0.01 | 4 | Inv. |
| 58 | | 1.2 | 19 | 70% | 0.15 | 100 | 3.3 | 0.01 | 0.01 | 4 | Inv. |
| 59 | | 0.5 | 8 | 70% | 0.13 | 90 | 3.0 | 0.01 | 0.01 | 4 | Inv. |
| 60 | | 0.2 | 3 | 70% | 0.12 | 60 | 1.5 | 0.01 | 0.01 | 3 | Comp. |
| 61 | 3-3 | 2.1 | 37 | 80% | 0.36 | 100 | 3.6 | 0.13 | 0.15 | 2 | Comp. |
| 62 | | 1.8 | 32 | 80% | 0.16 | 110 | 3.6 | 0.02 | 0.01 | 4 | Inv. |
| 63 | | 1.2 | 21 | 80% | 0.15 | 105 | 3.5 | 0.02 | 0.01 | 5 | Inv. |
| 64 | | 0.5 | 9 | 80% | 0.15 | 90 | 3.2 | 0.01 | 0.01 | 4 | Inv. |
| 65 | | 0.2 | 4 | 80% | 0.13 | 60 | 1.4 | 0.01 | 0.01 | 3 | Comp. |
| 66 | 3-4 | 2.1 | 37 | 80% | 0.35 | 110 | 3.6 | 0.13 | 0.15 | 2 | Comp. |
| 67 | | 1.8 | 32 | 80% | 0.15 | 110 | 3.6 | 0.02 | 0.01 | 4 | Inv. |
| 68 | | 1.2 | 21 | 80% | 0.15 | 100 | 3.5 | 0.02 | 0.01 | 5 | Inv. |
| 69 | | 0.5 | 9 | 80% | 0.15 | 95 | 3.1 | 0.01 | 0.01 | 4 | Inv. |
| 70 | | 0.2 | 4 | 80% | 0.13 | 65 | 1.5 | 0.01 | 0.01 | 3 | Comp. |
| 71 | 3-5 | 2.1 | 42 | 90% | 0.36 | 150 | 3.7 | 0.38 | 0.40 | 2 | Comp. |
| 72 | | 1.8 | 36 | 90% | 0.18 | 145 | 3.6 | 0.04 | 0.04 | 4 | Inv. |
| 73 | | 1.2 | 24 | 90% | 0.15 | 135 | 3.4 | 0.04 | 0.03 | 5 | Inv. |

TABLE 2-continued

| Sample No. | Used Coating Composition No. | Coated Silver Amount (g/m²) | Developed Silver Halide Grains Number (× 10³ grains/m²) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 74 | | 0.5 | 10 | 90% | 0.15 | 100 | 3.0 | 0.02 | 0.03 | 5 | Inv. |
| 75 | | 0.2 | 4 | 90% | 0.13 | 65 | 1.6 | 0.02 | 0.01 | 3 | Comp. |

As can clearly be seen from Tables 1 and 2, compared to comparative examples, the samples of the present invention exhibit excellent storage stability, image retention quality, as well as excellent silver image color.

Example 2

The emulsion side of some of the photosensitive materials prepared as above was subjected to laser scanning exposure, employing and exposure device using as the light source a semiconductor laser beam at a wavelength of 810 nm. During exposure, images were formed while setting the angle between the exposed surface of said photosensitive material and said laser beam at 75 degrees. Each sample was evaluated in the same manner as Example 1.

Table 3 shows the obtained results.

As can be seen from Table 3, compared to the comparative examples, the samples of the present invention exhibit excellent storage stability and image retention quality, as well as desired silver image color.

Example 3

The emulsion side of the photosensitive materials prepared as above was subjected to laser scanning exposure, employing an exposure device using as the light source a semiconductor laser beam which is subjected to the longitudinal multi-mode of a wavelength of 800 to 820 nm under high frequency, superposition. During exposure, images were formed while setting the angle between the exposed surface of said photosensitive material and said laser beam at 75 degrees.

Evaluation was carried out in the same manner as Examples 1 and 2. Table 4 shows the obtained results.

TABLE 3

| Sample No. | Used Coating Composition No. | Coated Silver Amount (g/m²) | Developed Silver Halide Grains Number (× 10³ grains/m²) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 6 | 1-2 | 2.1 | 12 | 80% | 0.32 | 120 | 3.9 | 0.13 | 0.20 | 1 | Comp. |
| 7 | | 1.8 | 1 | 80% | 0.18 | 120 | 3.8 | 0.02 | 0.01 | 4 | Inv. |
| 8 | | 1.2 | 7 | 80% | 0.15 | 105 | 3.6 | 0.02 | 0.01 | 4 | Inv. |
| 9 | | 0.5 | 3 | 80% | 0.15 | 55 | 1.6 | 0.02 | 0.01 | 2 | Comp. |
| 10 | | 0.2 | 1 | 80% | 0.14 | 35 | 0.6 | 0.01 | 0.01 | 2 | Comp. |
| 31 | 2-2 | 2.1 | 17 | 65% | 0.35 | 115 | 3.5 | 0.12 | 0.25 | 1 | Comp. |
| 32 | | 1.8 | 15 | 65% | 0.33 | 110 | 3.1 | 0.10 | 0.20 | 1 | Comp. |
| 33 | | 1.2 | 10 | 65% | 0.30 | 65 | 2.2 | 0.06 | 0.15 | 1 | Comp. |
| 34 | | 0.5 | 4 | 65% | 0.28 | 45 | 1.2 | 0.03 | 0.10 | 1 | Comp. |
| 35 | | 0.2 | 2 | 65% | 0.25 | 25 | 0.6 | 0.02 | 0.08 | 1 | Comp. |
| 56 | 3-2 | 2.1 | 33 | 70% | 0.35 | 120 | 3.8 | 0.12 | 0.13 | 1 | Comp. |
| 57 | | 1.8 | 28 | 70% | 0.18 | 110 | 3.7 | 0.01 | 0.01 | 4 | Inv. |
| 58 | | 1.2 | 19 | 70% | 0.15 | 105 | 3.5 | 0.01 | 0.01 | 4 | Inv. |
| 59 | | 0.5 | 8 | 70% | 0.13 | 95 | 3.2 | 0.01 | 0.01 | 4 | Inv. |
| 60 | | 0.2 | 3 | 70% | 0.12 | 60 | 1.4 | 0.01 | 0.01 | 2 | Comp. |

TABLE 4

| Sample No. | Used Coating Composition No. | Coated Silver Amount (g/m²) | Developed Silver Halide Grains Number (× 10³ grains/m²) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 6 | 1-2 | 2.1 | 112 | 80% | 0.32 | 125 | 4.1 | 0.13 | 0.20 | 1 | Comp. |
| 7 | | 1.8 | 1 | 80% | 0.18 | 125 | 4.1 | 0.02 | 0.01 | 4 | Inv. |
| 8 | | 1.2 | 7 | 80% | 0.15 | 110 | 3.8 | 0.02 | 0.01 | 4 | Inv. |
| 9 | | 0.5 | 3 | 80% | 0.15 | 55 | 1.6 | 0.02 | 0.01 | 2 | Comp. |

TABLE 4-continued

| Sample No. | Used Coating Composition No. | Coated Silver Amount ($g/m^2$) | Developed Silver Halide Grains Number ($\times 10^3$ grains/$m^2$) | Developed Silver Halide Grains Ratio (*) | Sensitometry Fog | Sensitometry Sensitivity | Sensitometry Dmax | Storage Stability | Image Retention Quality | Silver Image Color | Remarks |
|---|---|---|---|---|---|---|---|---|---|---|---|
| 10 | | 0.2 | 1 | 80% | 0.14 | 35 | 0.6 | 0.01 | 0.01 | 2 | Comp. |
| 31 | 2-2 | 2.1 | 17 | 65% | 0.35 | 120 | 3.5 | 0.12 | 0.25 | 1 | Comp. |
| 32 | | 1.8 | 15 | 65% | 0.33 | 115 | 3.1 | 0.10 | 0.20 | 1 | Comp. |
| 33 | | 1.2 | 10 | 65% | 0.30 | 70 | 2.2 | 0.06 | 0.15 | 1 | Comp. |
| 34 | | 0.5 | 4 | 65% | 0.28 | 45 | 1.2 | 0.03 | 0.10 | 1 | Comp. |
| 35 | | 0.2 | 2 | 65% | 0.25 | 25 | 0.6 | 0.02 | 0.08 | 1 | Comp. |
| 56 | 3-2 | 2.1 | 33 | 70% | 0.35 | 125 | 4.2 | 0.12 | 0.13 | 1 | Comp. |
| 57 | | 1.8 | 28 | 70% | 0.18 | 120 | 4.2 | 0.01 | 0.01 | 4 | Inv. |
| 58 | | 1.2 | 19 | 70% | 0.15 | 110 | 3.7 | 0.o1 | 0.o1 | 4 | Inv. |
| 59 | | 0.5 | 8 | 70% | 0.13 | 105 | 3.5 | 0.o1 | 0.01 | 4 | Inv. |
| 60 | | 0.2 | 3 | 70% | 0.12 | 60 | 1.3 | 0.01 | 0.01 | 2 | Comp. |

As can be sen from Table 4, compared to the comparative examples, the samples of the present invention exhibit excellent storage stability and image retention quality, as well as desired silver image color. Further, by adjusting the exposure angle to 75 degrees and carrying out exposure employing a longitudinal multi-mode, it is seen that excellent images with minimized uneven developement, as well as excellent sharpness are obtainable.

Example 4

Some of the photosensitive materials prepared as above were exposed in the same manner as Example 1 and developed for 15 seconds while varying the temperature during development as shown in Table 5, and then evaluated. Table 5 shows the results.

TABLE 5

| Sample No. | Development Temperature (° C.) | Sensitometry Fog | Sensitometry Sensitivity | Sensitometry Dmax | Storage Stability | Image Retention Quality | Silver Image Color | Remarks |
|---|---|---|---|---|---|---|---|---|
| 32 | 60 | 0.3 | 60 | 2.1 | 0.08 | 0.15 | 2 | Comp. |
| | 85 | 0.32 | 80 | 2.4 | 0.1 | 0.2 | 2 | Comp. |
| | 123 | 0.33 | 100 | 3 | 0.1 | 0.2 | 2 | Comp. |
| | 195 | 0.56 | 105 | 3.1 | 0.23 | 0.45 | 1 | Comp. |
| | 210 | 0.67 | 107 | 3.2 | 0.5 | 0.62 | 1 | Comp. |
| 57 | 60 | 0.15 | 80 | 2.8 | 0.01 | 0.01 | 3 | Inv. |
| | 85 | 0.16 | 104 | 3.4 | 0.01 | 0.01 | 4 | Inv. |
| | 123 | 0.18 | 105 | 3.4 | 0.01 | 0.01 | 4 | Inv. |
| | 195 | 0.19 | 108 | 3.4 | 0.01 | 0.01 | 5 | Inv. |
| | 210 | 0.34 | 110 | 3.4 | 0.08 | 0.09 | 3 | Inv. |

As can clearly be seen from Table 5, when the development temperature is set from 80 to 100° C., samples of the present invention exhibit excellent storage stability and image retention quality, as well as desired silver image color.

The present invention makes it possible to provide a heat developable photosensitive material which exhibits high covering power, high sensitivity, and minimized fogging when stored over a long period of time, and improved silver image color, and an image recording method as well as an image forming method using the same.

What is claimed is:

1. A photothermographic material comprising a support having thereon a photosensitive layer comprising non-photosensitive organic silver salt grains, photosensitive silver halide grains, a binder, a cross-linking agent, and a reducing agent, wherein a silver coverage in said photosensitive layer is from 0.3 to 2.0 $g/m^2$; the number of developed silver halide grains $N_1$ in the maximum density area is from $5\times10^{13}$ to $1\times10^{15}/m^2$ when said photothermographic material is subjected to exposure in an exposure amount of 280 $\mu J/cm^2$ and subsequently is subjected to heat development at 123° C. for 16.5 seconds; and, in the maximum density area, the number of developed silver halide grains $N_1$ and the number of undeveloped silver halide grains $N_2$ satisfy the formula;

$$0.70 \leqq N_1/(N_1+N_2) \leqq 0.95.$$

2. The photothermographic material of claim 1, wherein 1.5 to 90 weight % of said photosensitive silver halide grains is prepared by allowing non-photosensitive organic silver salt grains to react with a compound which contains a reactive halogen atom in the molecule.

3. The photothermographic material of claim 1, wherein 5 to 80 weight % of said photosensitive silver halide grains is prepared by allowing non-photosensitive organic silver salt grains to react with a compound which contains a reactive halogen atom in the molecule.

4. The photothermographic material of claim 1, wherein 10 to 70 weight % of said photosensitive silver halide grains is prepared by allowing non-photosensitive organic silver salt grains to react with a compound which contains a reactive halogen atom in the molecule.

5. The photothermographic material of claim 2, wherein the compound which contains a reactive halogen atom in the molecule is an onium salt having a halide anion or a polyhalide anion in the molecule.

6. A method of forming an image of photothermographic material, comprising the steps of:

(a) exposing said a photothermographic material with an exposure amount of 280 $\mu J/cm^2$; and (b) thermally developing said a photothermographic material at 123° C. for 16.5 seconds, wherein said photothermographic material comprises a support having thereon a photosensitive layer comprising non-photosensitive organic silver salt grains, photosensitive silver halide grains, a binder, a cross-linking agent, and a reducing agent; a silver coverage in said photosensitive layer is from 0.3 to 2.0 $g/m^2$; the number of developed silver halide grains $N_1$ in the maximum density area is from $5\times10^{13}$ to $1\times10^{15}$ per $m^2$; and in the maximum density area, the number of developed silver halide grains $N_1$ and the number of undeveloped silver halide grains $N_2$ satisfy the equation;

$$0.70 \leqq N_1/(N_1+N_2) \leqq 0.95.$$

* * * * *